US007325398B2

(12) United States Patent
Cherney

(10) Patent No.: US 7,325,398 B2
(45) Date of Patent: Feb. 5, 2008

(54) CLOSED CIRCUIT ENERGY RECOVERY SYSTEM FOR A WORK IMPLEMENT

(75) Inventor: Mark John Cherney, Potosi, WI (US)

(73) Assignee: Deere & Company, Moline, IL (US)

( * ) Notice: Subject to any disclaimer, the term of this patent is extended or adjusted under 35 U.S.C. 154(b) by 327 days.

(21) Appl. No.: 10/794,965

(22) Filed: Mar. 5, 2004

(65) Prior Publication Data

US 2005/0196288 A1 Sep. 8, 2005

(51) Int. Cl.
*F16D 31/02* (2006.01)

(52) U.S. Cl. ..... 60/476; 60/414

(58) Field of Classification Search ..... 60/414, 60/475, 476

See application file for complete search history.

(56) References Cited

U.S. PATENT DOCUMENTS

| | | | | |
|---|---|---|---|---|
| 1,560,705 | A * | 11/1925 | Mayer | 60/476 |
| 3,303,647 | A * | 2/1967 | Futamata | 60/468 |
| 3,971,215 | A * | 7/1976 | Baron et al. | 60/414 |
| 4,760,697 | A | 8/1988 | Heggie et al. | 60/494 |
| 4,761,954 | A * | 8/1988 | Rosman | 60/414 |
| 4,898,078 | A | 2/1990 | Gage et al. | 91/524 |
| 5,794,439 | A | 8/1998 | Lisniansky | 60/414 |
| 5,865,028 | A | 2/1999 | Klauk et al. | 60/413 |
| 6,519,939 | B1 * | 2/2003 | Duff | 60/475 |
| 2003/0188530 | A1 | 10/2003 | Inoue et al. | 60/476 |

FOREIGN PATENT DOCUMENTS

| | | |
|---|---|---|
| DE | 32 17 527 A1 | 11/1983 |
| DE | 40 08 792 A1 | 9/1991 |
| DE | 197 16 081 C1 | 8/1998 |
| DE | 103 43 016 A1 | 5/2005 |
| JP | 59086706 | 5/1984 |

OTHER PUBLICATIONS

NFPA-Solutions through Motion Technology, technical paper series 100-8.2, Regeneraticve Hydraulic Systems For Increase Efficiency, by Glenn R. Wendel, Southwest Research Institute.

* cited by examiner

*Primary Examiner*—Michael Leslie

(57) ABSTRACT

A closed circuit hydraulic system includes a fluid reservoir, a hydraulic cylinder having a cylinder rod, a bidirectional variable displacement hydraulic pump that pumps fluid to either extend or retract the cylinder rod on demand, a flow control valve for relieving pressure between the variable displacement hydraulic pump and the cylinder, and a low pressure check valve between the variable displacement hydraulic pump and the fluid reservoir. Also included is a charge pump for charging the variable displacement hydraulic pump and an accumulator for saving extra energy and fluid from the hydraulic cylinder during the retraction of an extended cylinder rod and using that fluid and energy during the extension of the hydraulic cylinder to reduce a load on the charge pump. The flow control valve opens on demand to allow floating. The low pressure check valve opens when pressure at an inlet of the variable displacement hydraulic pump is low to provide additional fluid and pressure so as to avoid cavitation. A method for using the closed circuit hydraulic system is also provided.

16 Claims, 2 Drawing Sheets

CLOSED CIRCUIT ENERGY RECOVERY SYSTEM FOR A WORK IMPLEMENT

FIELD OF THE INVENTION

The invention relates to an energy recovery circuit for a hydraulic apparatus of a work vehicle such as a loader, a backhoe or the like.

BACKGROUND OF THE INVENTION

In modern work vehicles, hydraulic circuits are used to power the hydraulic cylinders that manipulate work implements. Such systems may use pumps of the variable displacement type which control the flow rate of hydraulic fluid via manipulation of their displacement volumes. A displacement control valve is used to determine the direction of fluid flow to accomplish the work desired, i.e., for example, to extend or retract the hydraulic cylinder. The displacement control valve is also used to allow free flow of fluid so as to minimize pressure generated, i.e., to enable floating; an operating mode in which an implement rests on and follows the contours of the earth as the work vehicle is propelled along the ground.

In an overwhelming majority of hydraulic systems for work vehicles, hydraulic cylinders generate less power and use less fluid in moving to a retracted position than they do in moving to an extended position. Although charge pumps are used to make up volume differences in the fluid medium as the cylinder moves from a retracted position to an extended position, the risk of cavitation due to an inadequate supply of fluid to the variable displacement hydraulic pump is not entirely eliminated. Usually, the risk of cavitation is further reduced via the use of sophisticated and, generally, expensive valves.

SUMMARY OF THE INVENTION

As stated earlier, in conventional work vehicles, displacement control valves are used to direct flow from the hydraulic pumps for retraction or extension of the cylinder. However, this results in inefficiencies in the system as there are hydraulic pressure losses across the displacement control valves. In some technical literature, variable displacement hydraulic pumps are used to determine the direction of flow, thus, eliminating the need for displacement control valves for this function. However, such systems have not, heretofore, been actually utilized in a work vehicle to, for example, manipulate a work tool to do useful work. Provided herein is a closed circuit hydraulic system for a work vehicle that eliminates the displacement control valve through the use of an electro-hydraulic variable displacement hydraulic pump. The displacement pump controls the rate of fluid flow via adjustments in its displacement volume. It also determines the direction in which fluid flows for work purposes as it is multi-directional. Thus, a system is presented and claimed in which losses due to post compensation are substantially reduced in comparison to conventional systems.

As stated earlier, in conventional systems the risk of damage or malfunction due to cavitation is substantially reduced through the use of complex and expensive valves. Provided herein is an apparatus and a method to substantially reduce the risk of cavitation through the use of an accumulator and an inexpensive check valve with a low pressure drop for fluid make up.

In conventional systems the float function, i.e., the ability of the work tool to rest on and follow the contours of the earth as the work vehicle moves along the ground, is accomplished via a function in the displacement control valve. However, in the closed circuit provided herein the displacement control valve is eliminated along with the inefficiencies associated with nominal losses as the fluid passes through the valve. Provided herein is an apparatus and a method of accomplishing the float function without a displacement valve.

BRIEF DESCRIPTION OF THE DRAWINGS

Embodiments of the invention will be described in detail, with references to the following figures, wherein.

DESCRIPTION OF THE ILLUSTRATED EMBODIMENT

Figure 1:
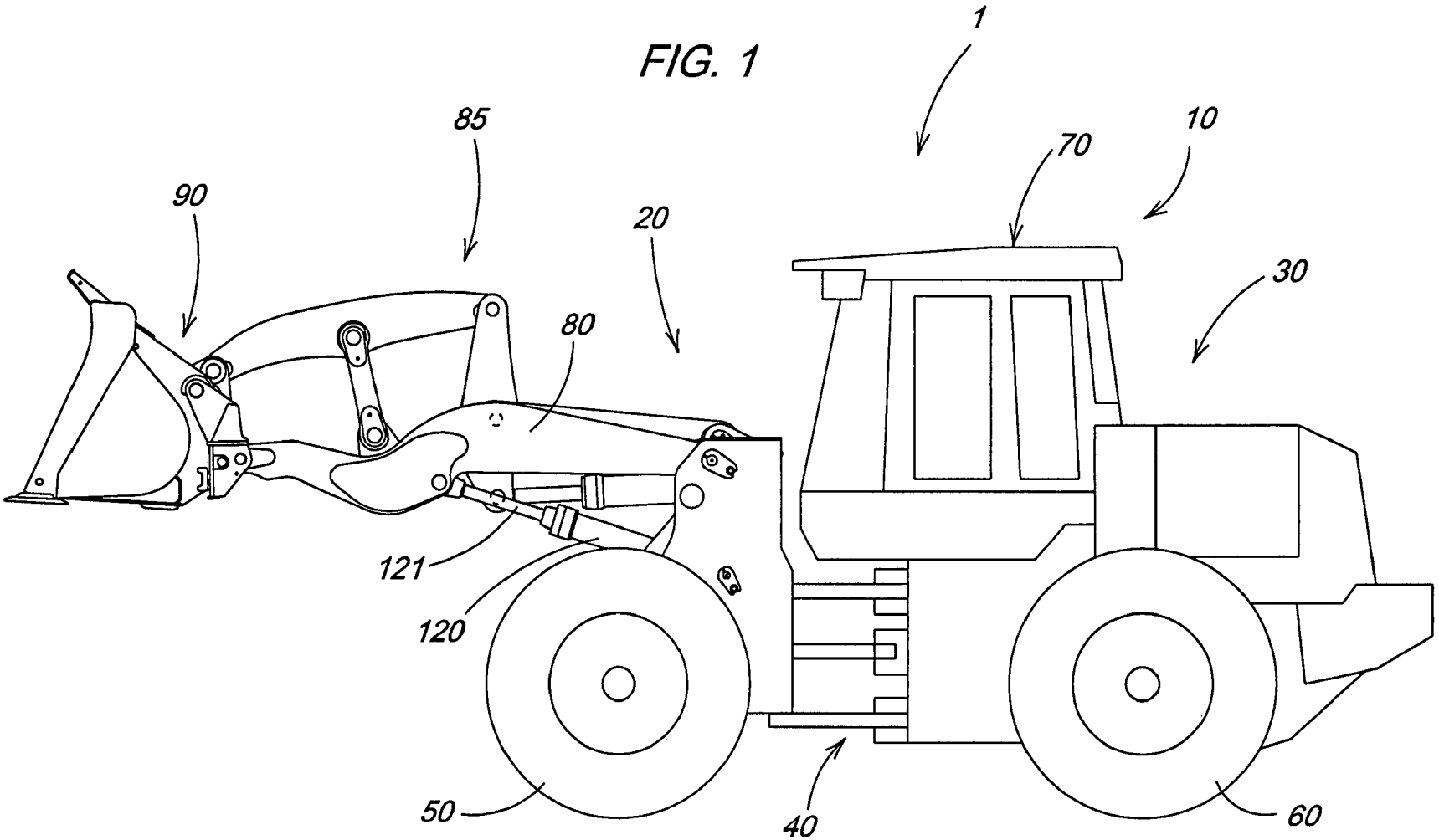
FIG. 1 is a view of a work vehicle in which the invention may be used.

FIG. 1 illustrates a work vehicle in which the invention may be used. The particular work vehicle illustrated in FIG. 1 is an articulated four wheel drive loader 1 having a main vehicle body 10 that includes a front vehicle portion 20 pivotally connected to a rear vehicle portion 30 by vertical pivots 40, the loader being steered by pivoting of the front vehicle portion 20 relative to the rear vehicle portion 30 in a manner well known in the art. The front and rear vehicle portions 20 and 30 are respectively supported on front drive wheels 50 and rear drive wheels 60. An operator's station 70 is provided on the rear vehicle portion 30 and is generally located above the vertical pivots 40. The front vehicle portion 20 includes a boom 80, a linkage assembly 85, a work tool 90 and a hydraulic cylinder 120. The front and rear drive wheels 50 and 60 propel the vehicle along the ground and are powered in a manner well known in the art.

Figure 2:
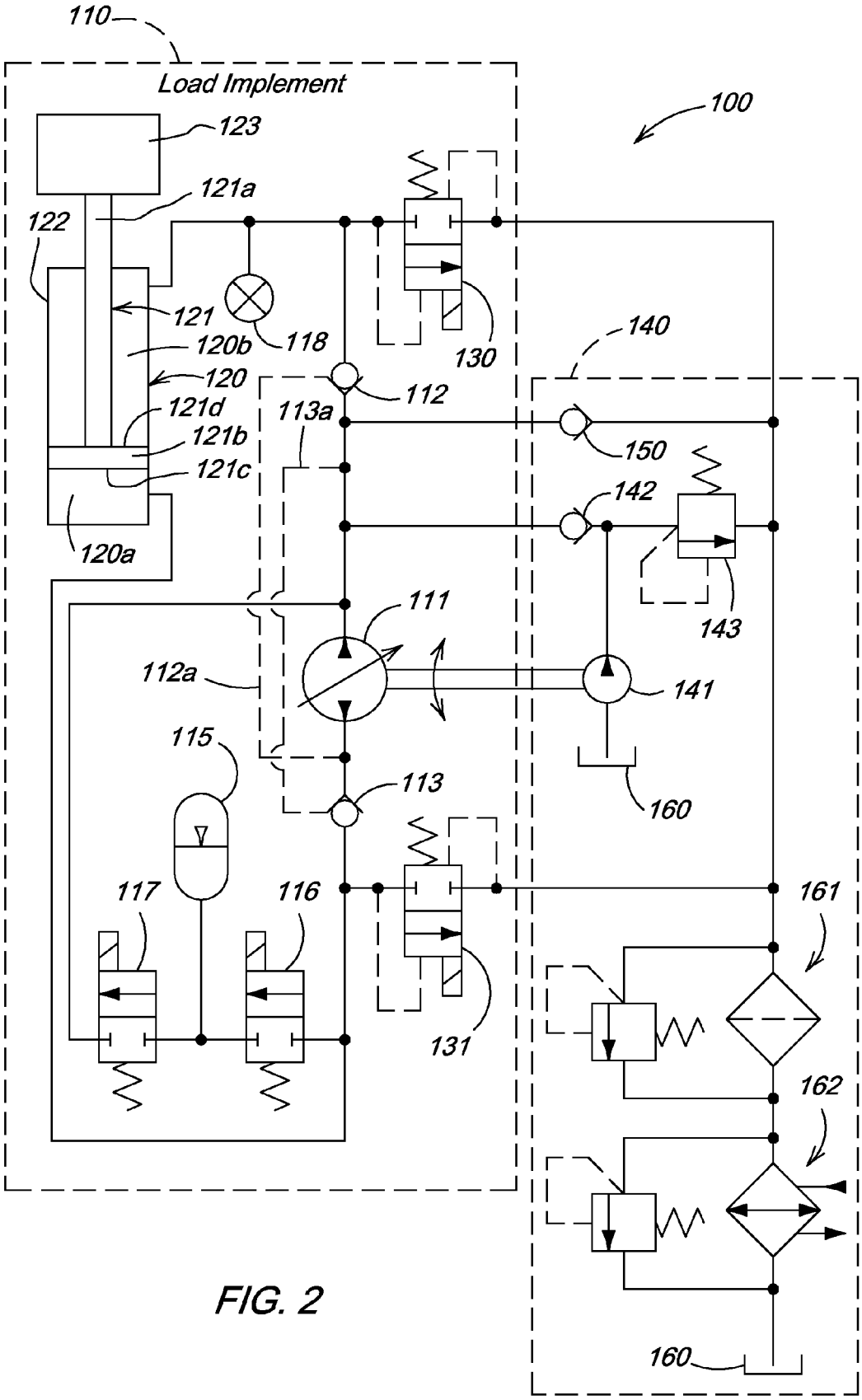
FIG. 2 is a diagram of an exemplary embodiment of the hydraulic circuit of the invention for the work vehicle in FIG. 1.

FIG. 2 illustrates a hydraulic circuit 100 representing an exemplary embodiment of the invention. The hydraulic circuit 100 illustrated includes a power circuit 110 for manipulating the implement and a charge circuit 140 for supplying additional fluid to the power circuit. The power circuit 110 incorporates a bidirectional variable displacement hydraulic pump 111, pilot check valves 112, 113, a pressure transducer 118, an accumulator 115, electro-hydraulic flow control valves 116, 117 for movement of hydraulic fluid into and out of the accumulator 115, and flow control or pilot controlled pressure relief valves 130 and 131 with electro-hydraulic override. A hydraulic cylinder 120 is in fluid communication with the power circuit in order to obtain the necessary power for useful work as in, for example, manipulating the work tool 90. The hydraulic cylinder 120 includes a first chamber 120*a*, a second chamber 120*b*, a cylinder rod 121, and a housing 122. The cylinder rod 121 includes a piston rod 121*a* and a piston 121*b*, the piston 121*b* having a first piston side 121*c* and a second piston side 121*d*. The first chamber 120*a* is formed by the first piston side 121*c* and all inner surfaces of the housing 122 exposed to the first piston side 121*c*. The second chamber 120*b* is formed by the second piston side 121*d* and all inner surfaces of the housing 122 exposed to the second piston side 121*d*. The charge circuit 140 includes a charge pump 141, a check valve 142 to prevent reverse flow on the charge pump 141, a pilot controlled pressure relief valve 143 for the charge pump 141, and an anti-cavitation check valve 150. Finally, included are a fluid reservoir 160, a fluid filter assembly 161, and a fluid cooler assembly 162.

In operation, the charge pump 141 charges the hydraulic pump 111 by supplying fluid from the fluid reservoir 160 and the hydraulic pump 111 supplies fluid to the hydraulic cylinder 120 through one of the check valves 112 and 113. Fluid supplied to the first chamber 120*a* via check valve 113 tends to extend the hydraulic cylinder 120; fluid supplied to the second chamber 120*b* via check valve 112 tends to retract the hydraulic cylinder 120. Pilot line 112*a* opens the check valve 112 when it is pressurized during an extension to allow fluid to flow from the second chamber 120*b* to the hydraulic pump 111. Pilot line 113*a* opens the check valve 113 when it is pressurized during a retraction to allow fluid to flow from the first chamber to the hydraulic pump 111. In this embodiment, the hydraulic pump 111 is the sole source of direction for pressurized fluid flow for the purpose of extending and retracting the cylinder rod 121.

As is readily observed in FIG. 2, more fluid is required to extend the hydraulic cylinder 120 than to retract it. This is due to a greater free volume in the first chamber 120*a* of a fully extended cylinder rod 121 than in the second chamber 120*b* of a fully retracted hydraulic cylinder 120. During normal operation of a work vehicle such as the loader 1, the hydraulic circuit 100 expends more energy during an extension of the hydraulic cylinder 120 than during a retraction as a load or weight 123 is generally lifted during an extension. Under such conditions, it is possible to recover a portion of the energy used in the extension process on retraction of the hydraulic cylinder 120 as the hydraulic cylinder 120 often retracts under at least the weight 123 of the implement 90, the linkage 85 and the boom 80. Thus the hydraulic circuit 100 opens flow control valve 116 to allow extra fluid from the first chamber 120*a* of an extended hydraulic cylinder 120 to flow into the accumulator 115 when the hydraulic pump 111 is directed to supply fluid to the second chamber 120*b*. Naturally, the flow control valve 117 remains closed at this time.

The fluid stored in the accumulator 115 may be recovered in a variety of ways. In this particular embodiment, the fluid is recovered during an extension of the cylinder rod 121. When the hydraulic pump 111 is directed to supply fluid to the extension side 121*a* of the cylinder rod 121, the flow control valve 117 is directed to open and allow fluid from the accumulator 115 to flow to the intake side of the hydraulic pump 111, thus supplementing the fluid supply to the side of higher volume requirements and reducing any potential load on the charge pump 141. Under these conditions it is possible to actually reduce the size or capacity of the charge pump 141, thereby saving energy without negatively impacting the efficiency or the effectiveness of the overall hydraulic circuit 100.

During an extension of the hydraulic cylinder 120, the fluid supply to the hydraulic pump 111 may, at times, be inadequate even when the accumulator 115 and the charge pump 141 are functioning properly but especially when the energy from the accumulator 115 is applied to some function other than extending the hydraulic cylinder 120. Under these circumstances the fluid pressure on the intake side of the hydraulic pump 111 may fall to a level at which cavitation is possible. When fluid pressure approaches these levels, the low pressure anti-cavitation check valve 150 to allow fluid to flow from the fluid reservoir 160, through the anti-cavitation check valve 150 to supplement the fluid supply to the hydraulic pump 111.

The pressure relief valves 130 and 131 are provided to relieve excessive pressures in the working circuit 101. However, during normal operations of a working vehicle such as, for example, the loader 1, the operator may want the work tool 90 to slide along the ground, following the contours of the earth as the loader 1 is propelled along the ground. At these times the electro-hydraulic override of the pressure relief valves 130 and 131 may be used to remotely open the pressure relief valves 130 and 131 to allow fluid to freely flow through them and, thus, allow the work implement 90 to float, i.e., to slide along the ground following the contours of the earth with minimal resistance.

Having described the illustrated embodiment, it will become apparent that various modifications can be made without departing from the scope of the invention as defined in the accompanying claims. For instance, the energy and fluid recovered from the accumulator 115 could be directed to the brakes.

The invention claimed is :

1. A closed circuit hydraulic system for a work vehicle, comprising:

a hydraulic cylinder, the hydraulic cylinder having a first chamber and a second chamber;

a bidirectional variable displacement hydraulic pump, the bidirectional variable displacement hydraulic pump in fluid communication with the hydraulic cylinder, the bidirectional variable displacement hydraulic pump selectively pumping and directing to the first chamber to extend the hydraulic cylinder and to the second chamber to retract the hydraulic cylinder, the hydraulic cylinder extending against a weight, the hydraulic cylinder retracting under the weight;

an accumulator in flow communication with the first chamber, the accumulator storing fluid from the first chamber during a retraction of the hydraulic cylinder under the weight and releasing the fluid as a supply to the bidirectional variable displacement hydraulic pump during an extension of the hydraulic cylinder; and at least one flow control valve for relieving hydraulic pressure between the bidirectional variable displacement hydraulic pump and the hydraulic cylinder, wherein the bidirectional variable displacement hydraulic pump is in direct communication with the first chamber and with the second chamber, the bidirectional variable displacement hydraulic pump is in direct communication with the first chamber and with the second chamber and the pressure relief valve includes an electro-hydraulic override.

2. The closed circuit hydraulic system of claim 1, wherein the work vehicle includes a work tool and wherein the electro-hydraulic override opens the at least one flow control valve to enable the work tool to float.

3. The closed circuit hydraulic system of claim 1, further comprising:

a fluid reservoir; and an anti-cavitation check valve, the anti-cavitation check valve opening at a predetermined pressure in a fluid supply to the bidirectional variable displacement hydraulic pump, the predetermined pressure being set to reduce the risk of cavitation as fluid pressure on an intake side of the bi-directional variable displacement hydraulic pump approaches a level at which cavitation may occur, the anti-cavitation valve opening to allow fluid from the fluid reservoir to increase the pressure at the intake side of the bidirectional variable displacement hydraulic pump.

4. The closed circuit hydraulic system of claim 1, furthering comprising:

a first accumulator flow control valve; and a second accumulator flow control valve, the first accumulator flow control valve in fluid communication with the accumulator and with the first chamber, the second accumulator flow control valve in fluid communication with the accumulator and with an inlet for the bidirectional variable displacement hydraulic pump.

5. The closed circuit hydraulic system of claim 4, wherein the first accumulator flow control valve opens to allow the accumulator to store excess fluid from the first chamber during a retraction of an extended hydraulic cylinder, the second accumulator flow control valve being closed.

6. The closed circuit hydraulic system of claim 5, wherein the second accumulator flow control valve opens to allow the accumulator to release the excess fluid to an inlet side of the bidirectional variable displacement hydraulic pump during an extension of a retracted cylinder, the first accumulator flow control valve being closed.

7. The closed circuit hydraulic system of claim 1, further comprising:

a fluid reservoir; and a charge pump, the charge pump supplying fluid from the fluid reservoir to an intake side of the bidirectional variable displacement hydraulic pump.

8. A closed circuit hydraulic system for a work vehicle, comprising:

a fluid reservoir a hydraulic cylinder, the hydraulic cylinder having a first chamber and a second chamber;

a bidirectional variable displacement hydraulic pump, the bidirectional variable displacement hydraulic pump in fluid Communication with the hydraulic cylinder, the bidirectional variable displacement hydraulic pump selectively pumping and directing fluid from the fluid reservoir to the first chamber to extend the cylinder rod and to the second chamber to retract the cylinder rod, the hydraulic cylinder extending against a weight, the hydraulic cylinder retracting under the weight;

an accumulator in flow communication with the first chamber, the accumulator storing fluid from the first chamber during a retraction of the hydraulic cylinder under the weight and releasing the fluid as a supply to the bidirectional variable displacement hydraulic pump during an extension of the hydraulic cylinder; and an anti-cavitation check valve, the anti-cavitation check valve opening at a predetermined pressure in a fluid supply to the bidirectional variable displacement hydraulic pump, the predetermined pressure being set to reduce the risk of cavitation as fluid pressure on an intake side of the bidirectional variable displacement hydraulic pump approaches a level at which cavitation may occur, the anti-cavitation valve opening to allow fluid from the fluid reservoir to increase the pressure at the intake side of the bidirectional variable displacement hydraulic pump.

9. A work vehicle having at least one implement, the at least one implement being powered by a closed circuit hydraulic system, the closed circuit hydraulic system comprising:

a hydraulic cylinder, the hydraulic cylinder having a cylinder rod, the cylinder rod having an extension side and a retraction side;

a bidirectional variable displacement hydraulic pump, the bidirectional variable displacement hydraulic pump in fluid communication with the hydraulic cylinder, the bidirectional variable displacement hydraulic pump selectively pumping and directing to the extension side to extend the cylinder rod and to the retraction side to retract the cylinder rod, the hydraulic cylinder extending against a weight, the hydraulic cylinder retracting under the weight;

an accumulator in flow communication with the first chamber, the accumulator storing fluid from the extension side during a retraction of the hydraulic cylinder under the weight and releasing the fluid as a supply to the bidirectional variable displacement hydraulic pump during an extension of the hydraulic cylinder; and at least one flow control valve for relieving hydraulic pressure between the bidirectional variable displacement hydraulic pump and the hydraulic cylinders, wherein the bidirectional variable displacement hydraulic pump is in direct communication with the extension side and with the retraction side, the at least one flow control valve comprises a pilot controlled pressure relief valve and the pressure relief valve includes an electro-hydraulic override.

10. The work vehicle of claim 9, wherein the electro-hydraulic override opens the at least one flow control valve to enable the implement to float.

11. The work vehicle of claim 9, further comprising:

a fluid reservoir; and an anti-cavitation check valve, the anti-cavitation check valve opening at a predetermined pressure in a fluid supply to the bidirectional variable displacement hydraulic pump, the predetermined pressure being set to reduce the risk of cavitation as fluid pressure on an intake side of the bidirectional variable displacement hydraulic pump approaches a level at which cavitation may occur, the anti-cavitation valve opening to allow fluid from the fluid reservoir to increase the pressure at the intake side of the bidirectional variable displacement hydraulic pump.

12. The work vehicle of claim 9, wherein the closed circuit hydraulic system further comprises: an accumulator; a first accumulator flow control valve; and a second accumulator flow control valve, the first accumulator flow control valve in fluid communication with the accumulator and with the extension side, the second accumulator flow control valve in fluid communication with the accumulator and with an inlet for the bidirectional variable displacement hydraulic pump.

13. The work vehicle of claim 12, wherein the first accumulator flow control valve opens to allow the accumulator to store excess fluid from the extension side during a retraction of an extended cylinder, the second accumulator flow control valve being closed.

14. The work vehicle of claim 13, wherein the second accumulator flow control valve opens to allow the accumulator to release the excess fluid to an inlet side of the bidirectional variable displacement hydraulic pump during an extension of a retracted cylinder, the first accumulator flow control valve being closed.

15. The work vehicle of claim 9, further comprising:

a fluid reservoir; and a charge pump, the charge pump supplying fluid from the fluid reservoir to an intake side of the bidirectional variable displacement hydraulic pump.

16. A work vehicle having at least one work tool, the at least one work tool being powered by a closed circuit hydraulic system, the closed circuit hydraulic system comprising:

a fluid reservoir;

a hydraulic cylinder, the hydraulic cylinder having a cylinder rod, the cylinder rod having an extension side and a retraction side;

a bidirectional variable displacement hydraulic pump, the bidirectional variable displacement hydraulic pump in fluid communication with the hydraulic cylinder, the bidirectional variable displacement hydraulic pump selectively pumping and directing fluid to the extension side to extend the cylinder rod and to the retraction side to retract the cylinder rod, the hydraulic cylinder extending against a weight, the hydraulic cylinder retracting under the weight;

an accumulator in flow communication with the extension side, the accumulator storing fluid from the extension side during a retraction of the hydraulic cylinder under the weight and releasing the fluid as a supply to the bidirectional variable displacement hydraulic pump during an extension of the hydraulic cylinder; and an anti-cavitation check valve, the anti-cavitation check valve opening at a predetermined pressure in a fluid supply to the bidirectional variable displacement hydraulic pump, the predetermined pressure being set to reduce the risk of cavitation as fluid pressure on an intake side of the pump approaches a level at which cavitation may occur, the anti-cavitation valve opening to allow fluid from the fluid reservoir to increase the pressure at the intake side of the bidirectional variable displacement hydraulic pump.

* * * * *